US006644249B2

(12) United States Patent
Itakura et al.

(10) Patent No.: US 6,644,249 B2
(45) Date of Patent: Nov. 11, 2003

(54) COOLING MECHANISM FOR ENGINE ELECTRONIC CONTROL MODULE

(75) Inventors: Keisuke Itakura, Hekinan (JP); Yasuo Sagisaka, Komaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/062,518

(22) Filed: Feb. 5, 2002

(65) Prior Publication Data

US 2002/0104490 A1 Aug. 8, 2002

(30) Foreign Application Priority Data

Feb. 7, 2001 (JP) ..... 2001-031447

(51) Int. Cl.[7] ..... F01P 1/06
(52) U.S. Cl. ..... 123/41.31; 123/198 E
(58) Field of Search ..... 123/41.31, 184.21, 123/198 E

(56) References Cited

U.S. PATENT DOCUMENTS 4,006,724 A * 2/1977 Carter ..... 123/198 E
4,926,821 A * 5/1990 Porth et al. ..... 123/198 E
5,207,186 A * 5/1993 Okita ..... 123/41.31
5,713,322 A * 2/1998 Mausner et al. ..... 123/184.21
5,988,119 A * 11/1999 Trublowski et al. ..... 123/41.31

FOREIGN PATENT DOCUMENTS

JP 6-137146 5/1994

* cited by examiner

*Primary Examiner*—Noah P. Kamen
(74) *Attorney, Agent, or Firm*—Nixon & Vanderhye, PC

(57) ABSTRACT

In a cooling mechanism for an engine electronic control module, a base plate of the engine electronic control module is attached to an intake pipe, and includes air rectifier fins. The air rectifier fins have an air rectification function for concentrating suction-air streams at a position while rectifying the suction-air streams, and a cooling function for cooling the engine electronic control module. Suction air flows into an intake duct, in which an air flow meter is provided, through the air rectifier fins. Therefore, eddies of air can be restricted from being generated at an upstream side of the air flow meter, thereby obtaining stable air-flow signals from the air flow meter.

10 Claims, 5 Drawing Sheets

COOLING MECHANISM FOR ENGINE ELECTRONIC CONTROL MODULE

CROSS REFERENCE TO RELATED APPLICATION

This application is based on and incorporates herein by reference Japanese Patent Application No. 2001-31447 filed Feb. 7, 2001.

FIELD OF THE INVENTION

The present invention relates to a cooling mechanism for cooling an engine electronic control module (ECM), which is less affected by heat of a vehicle engine. Here, the engine electronic control module, mounted in a vehicle, performs an electronic control such as a fuel injection control.

BACKGROUND OF THE INVENTION

A conventional engine electronic control module, mounted in a vehicle, is disposed in a passenger compartment to be protected from heat of a vehicle engine. Since many of sensors for the engine electronic control module are disposed in an engine compartment, wiring length becomes longer between the engine electronic control module and the sensors, thereby increasing wiring work, wiring cost and a wiring space. Further, electromagnetic noise is generated in the wiring.

It is therefore proposed in JP-A-H6-137146 to cool a computer of an engine electronic control module mounted in a vehicle in the following manner. That is, the computer contained in a case is disposed in an intake pipe, and only wiring harnesses are taken out from the intake pipe, so that a temperature of the computer is restricted from being increased using air flowing in the intake pipe. Otherwise, the computer contained in the case is disposed on the intake pipe so that a radiation body integrated with the case protrudes inside the intake pipe, so that the temperature of the computer is decreased through the radiation body using air flowing in the intake pipe.

However, in this cooling manner, eddies of air cannot be prevented from being irregularly generated at an upstream side of an air flow meter. Therefore, since an air-flow amount signal from the air flow meter becomes unstable, engine output characteristics become unstable. Further, since air flows toward a non-restricted part in the intake pipe, a sufficient cooling effect cannot be obtained.

SUMMARY OF THE INVENTION

Therefore, the present invention has an object to provide a cooling mechanism which can effectively cool an engine electronic control module so that the engine electronic control module can stably obtain an air-flow amount signal from an air flow meter by restricting eddies of air from being irregularly generated at an upstream side of the air flow meter.

In a cooling mechanism for an engine electronic control module according to one aspect of the present invention, a base plate of an engine electronic control module is attached to the intake pipe from which air is sucked for an engine. The base plate includes air rectifier fins for cooling the engine electronic control module, for concentrating suction-air streams at a position on the base plate while rectifying the suction-air streams, and for transferring the suction air to an suction-air introduction port of an air flow meter. Therefore, eddies can be prevented from being irregularly generated at an upstream side of the air flow meter, so that an air-flow amount signal can be stably obtained from the air flow meter. Additionally, the engine electronic control module can be effectively cooled.

According to another aspect of the present invention, an introduction plate or an air-stream changing mechanism is provided in the intake pipe at an upstream side of the base plate singly or in addition to the air rectifier fins.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Figure 1:
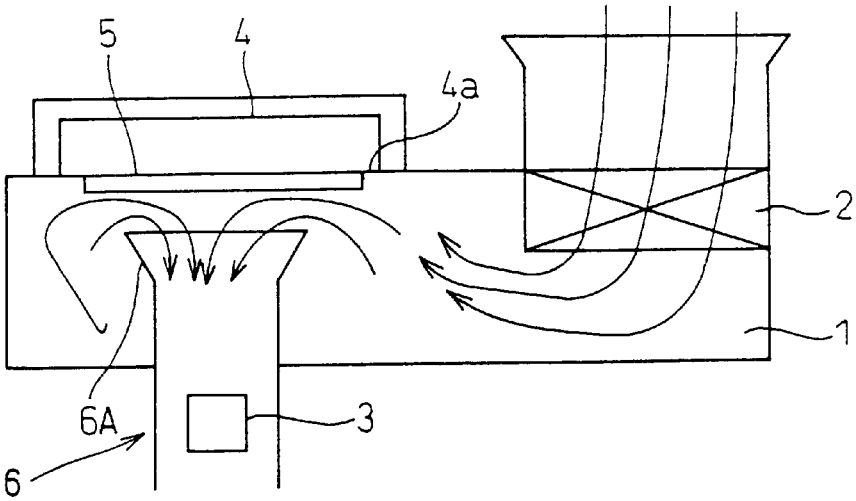
FIG. 1 is a schematic view showing an intake pipe having a cooling mechanism for an engine electronic control module according to a first embodiment of the present invention.

Hereinafter, a cooling mechanism for an engine electronic control module (ECM) is described in detail with reference to various embodiments shown in the drawings.

(First Embodiment)

In FIG. 1, an intake pipe 1 of an engine (not shown) has an air cleaner element 2 to clean air and is coupled with an intake duct 6. Air passing through the air cleaner element 2 flows generally horizontally in the intake pipe 1 and then vertically in the intake duct 6, in the case of an intake system arrangement shown in FIG. 1. This air flows through an air flow meter 3 in the intake duct 6. Thereafter, the air flows into an intake manifold (not shown) of the engine through a throttle valve (not shown) and a surge tank (not shown). An engine electronic control module 4 including an electronic computer (not shown) and the like therein is attached to the intake pipe 1 between the air cleaner element 2 and the air flow meter 3. Specifically, suction air is introduced from the intake duct 6 into the engine through the intake manifold.

The intake duct 6 is disposed so that its inlet part is located in the intake pipe 1. An opening of the intake duct 6 is provided in the intake pipe 1 as a suction-air introduction port 6A. A base plate 4*a* of the engine electronic control module 4 is attached to the intake pipe 1 around the suction-air introduction port 6A.

The base plate 4*a* includes air rectifier fins 5 on its bottom side, which faces the suction-air introduction port 6A. The air rectifier fins 5 have a rectification function for concentrating suction-air streams at a position while rectifying the suction-air streams. Further, the air rectifier fins 5 have a cooling function for cooling the engine electronic control module 4.

Figure 2A:
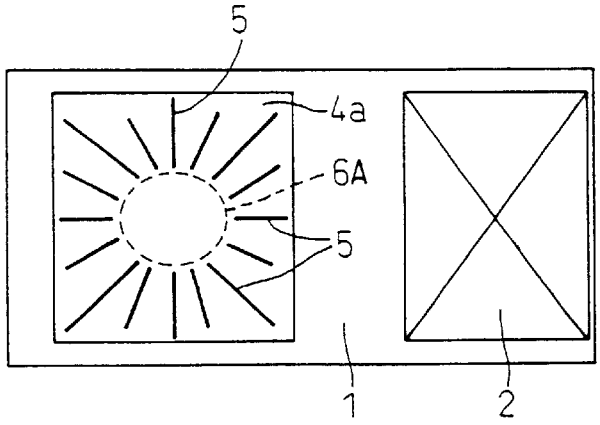
FIGS. 2A–2C are schematic views each showing air rectifier fins when a suction-air introduction port of an air flow meter is located directly below a center of the engine electronic control module in the cooling mechanism according to the first embodiment.
Figure 2B:
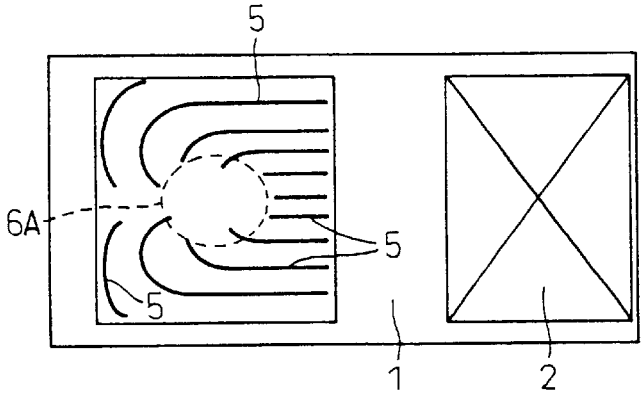
Figure 2C:
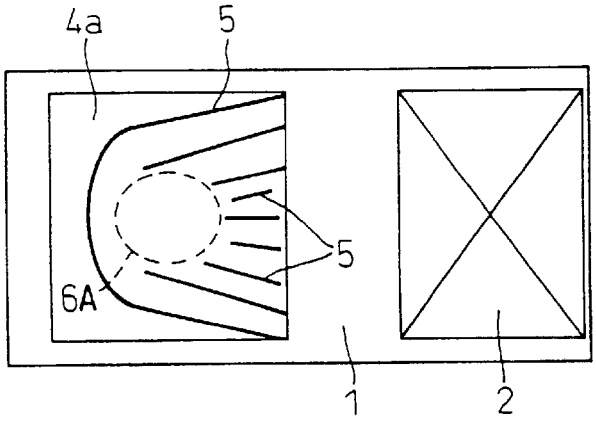

FIGS. 2A–2C show four examples of shape of the air rectifier fins 5, respectively, when the suction-air introduction port 6A is located directly below a center of the base plate 4*a*. Each of the fins 5 is shaped to project toward the suction-air introduction port 6A. In the example shown in FIG. 2A, the air rectifier fins 5 are formed on the base plate 4*a* from its center in its radial direction so that suction air is introduced to the intake duct 6 from all the directions on the base plate 4*a*. Therefore, turbulent flow can be restricted from occurring in the intake duct 6. In the example shown in FIG. 2B, the air rectifier fins 5 are formed so that the suction air flows in parallel from an upstream side (air cleaner element side), and air-streams deviating the center of the base plate 4*a* are halfway changed toward the center. In the example shown in FIG. 2C, the air rectifier fins 5 are formed on the base plate 4*a* slantingly toward the center so that air-streams are directed toward the center from the upstream side.

Figure 3:
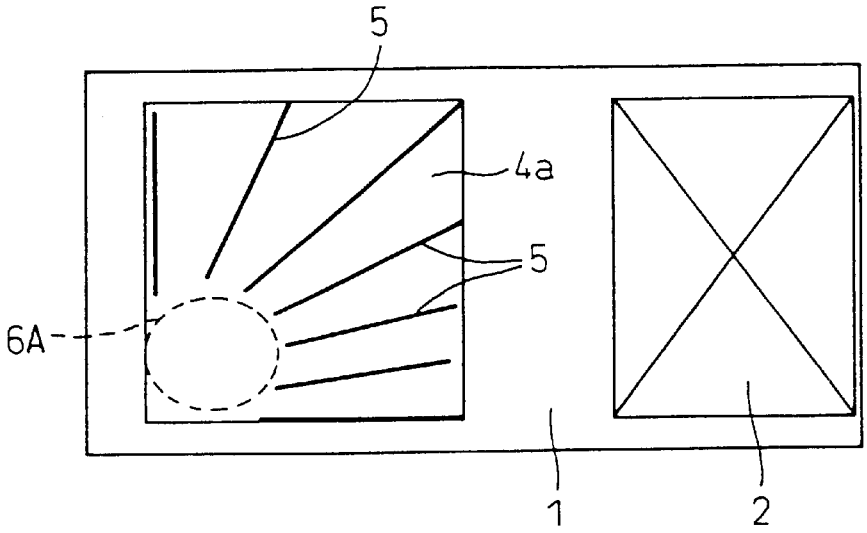
FIG. 3 is a schematic view showing a air rectifier fin when the suction-air introduction port of an air flow meter is located directly below a corner portion of the engine electronic control module in the cooling mechanism according to the first embodiment.

In another example of the air rectifier fins 5 shown in FIG. 3, the suction-air introduction port 6A is located directly below a corner portion of the base plate 4*a*. Therefore, the air rectifier fins 5 are formed on the base plate 4*a* from the corner portion in the radial direction so that the air-streams are concentrated at the corner portion.

(Second Embodiment)

Figure 4A:
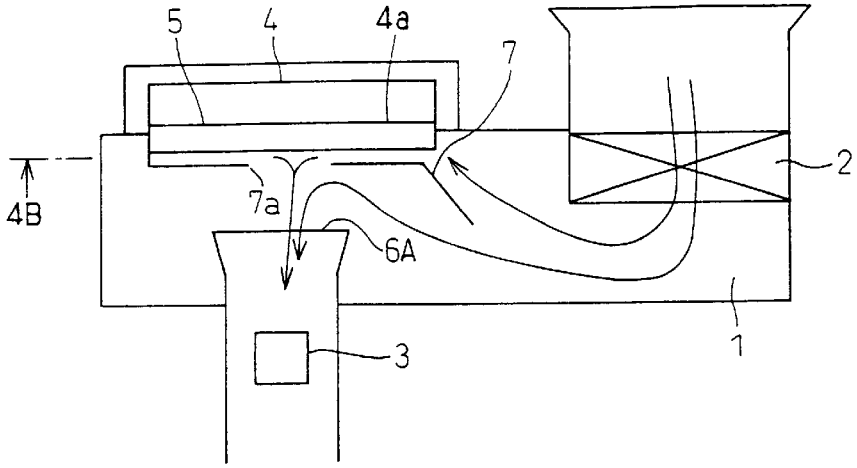
FIG. 4A is a schematic view showing an intake pipe having a cooling mechanism for an engine electronic control module according to a second embodiment of the present invention.
Figure 4B:
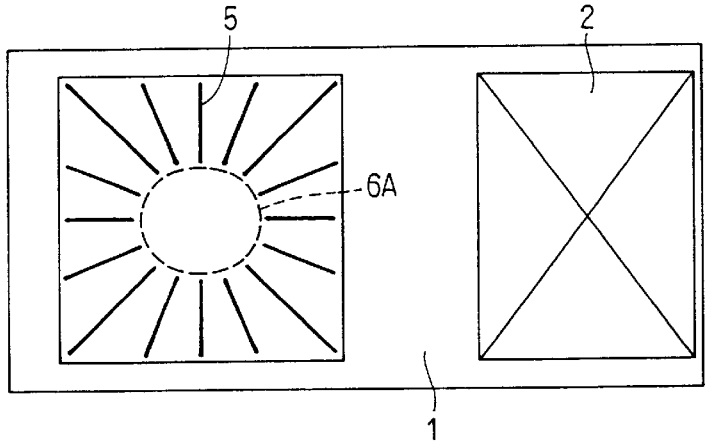
FIG. 4B is a schematic view taken in the direction of arrow 4B in FIG. 4A.

In a second embodiment shown in FIGS. 4A and 4B, an air-stream is divided into plural streams in the intake pipe 1. More specifically, as shown in FIG. 4A, an introduction plate 7 is provided between the air rectifier fins 5 and the suction-air introduction port 6A. Thus, one stream is forcibly introduced to the engine electronic control module 4 by the introduction plate 7. Other streams of air are introduced into the suction-air introduction port 6A without passing through the air rectifier fins 5. The introduction plate 7 has a discharge port 7*a* from which the introduced air is discharged to the suction-air introduction port 6A. The discharge port 7*a* is located around the suction-air introduction port 6A. As shown in FIG. 4B, the air rectifier fins 5 are formed on the base plate 4*a*. However, the air rectifier fins 5 can have another shape such as the shapes shown in FIGS. 2B–2C, 3.

(Third Embodiment)

Figure 5:
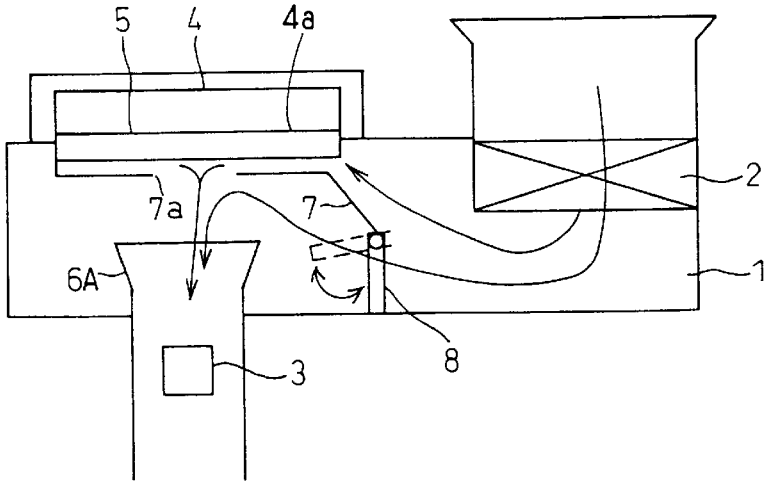
FIG. 5 is a schematic view showing an intake pipe having a cooling mechanism for an engine electronic control module according to a third embodiment of the present invention.

In a third embodiment, as shown in FIG. 5, a movable valve mechanism 8 for changing an air-stream direction is provided on an end of the introduction plate 7 at the upstream side. When an air-stream amount is small, the air-stream is introduced only to the engine electronic control module 4 by closing the valve mechanism 8 as shown with a solid line, so that the engine electronic control module 4 is sufficiently cooled. When the air-stream amount is large, the air-stream is divided into two air-streams by opening the valve mechanism 8 as shown with a dotted line, so that pressure loss of the air-stream is reduced. The valve mechanism 8 having a spring may be operated by a pressure difference between the upstream side and the downstream side of the valve mechanism 8. Further,the valve mechanism 8 may be operated by an actuator such as a direct-current motor controlled using a control signal from the engine electronic control module 4. In the third embodiment, too, the air rectifier fins 5 are formed on the base plate 4*a*.

(Fourth Embodiment)

Figure 6A:
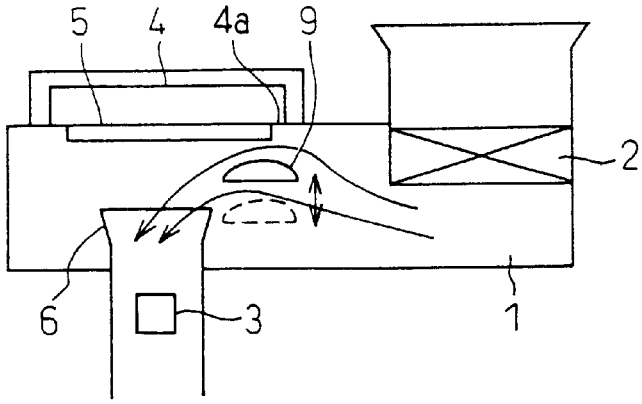
FIGS. 6A–6C are schematic views each showing a cooling mechanism for an engine electronic control module according to a fourth embodiment of the present invention.
Figure 6B:
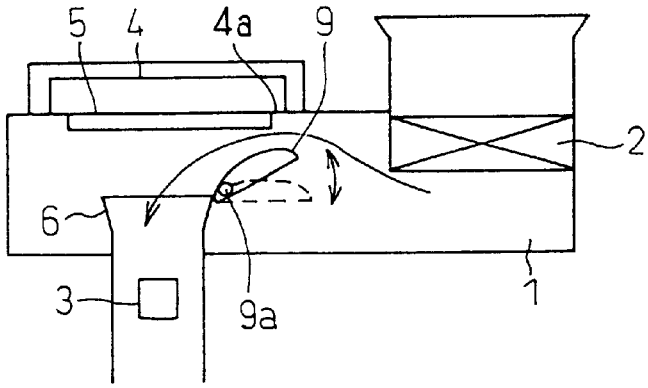
Figure 6C:
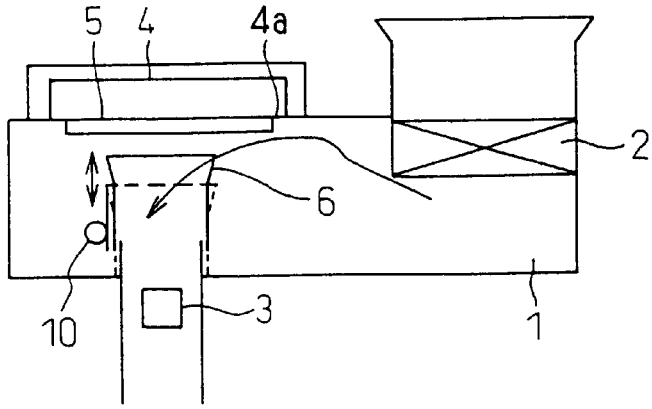

In a fourth embodiment, as shown in FIGS. 6A–6C, an air-stream changing mechanism for changing an air-stream direction is provided at the upstream side of the air rectifier fins 5 of the engine electronic control module 4. FIGS. 6A–6C show three examples of the air-stream changing mechanism, respectively. In the example shown in FIG. 6A, the air-stream changing mechanism is constructed so that a flap 9 can move in an up-down direction. When the air-stream amount is small, the flap 9 moves upward as shown with a solid line, so that the air stream rectification is preferentially performed. When the air-stream amount is large, the flap 9 moves downward as shown with a dotted line, so that the pressure loss of the air-stream is reduced. In the example shown in FIG. 6B, a shaft 9*a* of the flap 9 is fixed at a top end of the air duct 6, and the flap 9 is rotatably attached to the shaft 9*a*. When the air-stream amount is small, the flap 9 is rotated upward. When the air-stream amount is large, the flap 9 is rotated downward. In the example shown in FIG. 6C, the air-stream changing mechanism is constructed so that the suction-air introduction port 6A can slide in the up-down direction in the intake pipe 1. For example, the changing mechanism of the suction-air introduction port 6A may be a gear mechanism 10. When the air-stream amount is small, the suction-air introduction port 6A slides upward. When the air-stream amount is large, the suction-air introduction port 6A slides downward.

(Fifth Embodiment)

Figure 8A:
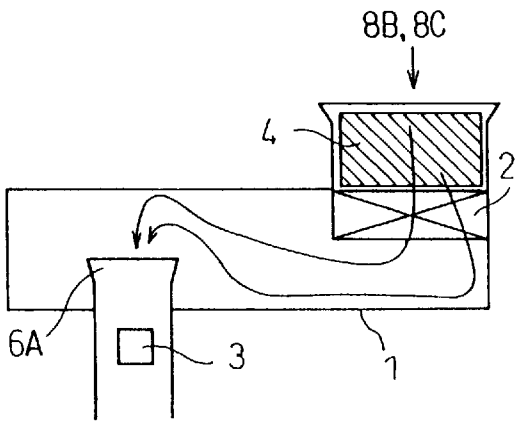
FIG. 8A is a schematic view showing a cooling mechanism for an engine electronic control module according to the fifth embodiment when the engine electronic control module is disposed in the intake pipe at an air cleaner upstream side.
Figure 8C:
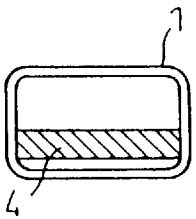
FIGS. 8B and 8C are schematic views each being taken in the direction of arrow 8B (8C) in FIG. 8A.
Figure 8B:
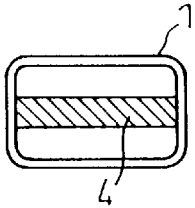
Figure 7A:
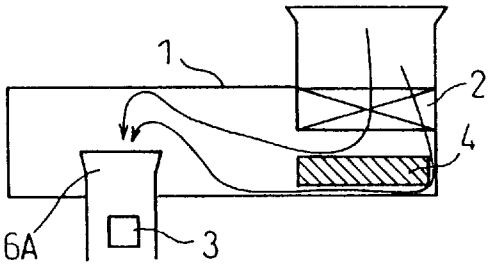
FIGS. 7A–7D are schematic views each showing a cooling mechanism for an engine electronic control module according to a fifth embodiment of the present invention when the engine electronic control module is disposed in the intake pipe at an air cleaner downstream side.
Figure 7B:
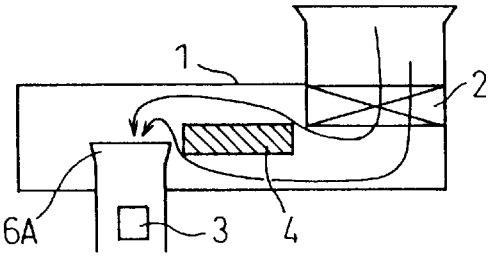
Figure 7C:
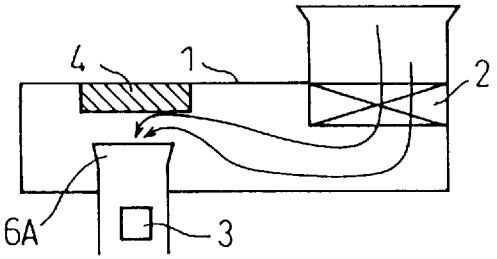
Figure 7D:
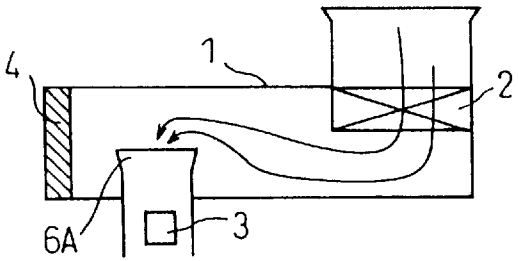

In a fifth embodiment, as shown in FIGS. 7A–7D and 8A–8C, the engine electronic control module 4 is disposed within the intake pipe 1. In the example shown in FIGS. 7A–7D, the engine electronic control module 4 is disposed in the intake pipe 1 at a cleaned air side, that is, between the air cleaner element 2 and the suction-air introduction port 6A. In the example shown in FIGS. 8A–8C, the engine electronic control module 4 is disposed in the intake pipe 1 at a non-cleaned air side, that is, directly above the air cleaner element 2 at its upstream side. Further, as shown in FIGS. 8B, 8C, the engine electronic control module 4 is disposed at a center portion in a cross-section of an air passage of the intake pipe 1 or at a side portion deviated to one side from the center portion.

While the present invention has been shown and described with reference to the foregoing preferred embodiments, it will be apparent to those skilled in the art that changes in form may be made therein without departing from the scope of the invention. For instance, the air rectifier fins 5 may be eliminated in the second embodiment to the fourth embodiment. Further, the air rectifier fins 5 may be formed on a case of the engine electronic control module 4 in place of the base plate 4*a*.

What is claimed is:

1. A cooling mechanism comprising:

an intake pipe from which air is sucked for an engine;

an intake duct having a suction-air introduction port opening in the intake pipe;

an air flow meter disposed in the intake pipe for detecting an amount of suction air;

an engine electronic control module including a base plate attached to the intake duct; and air rectifier fins provided on the base plate for cooling the engine electronic control module, for concentrating suction-air streams at one position on the base plate while rectifying the suction-air streams, and for transferring the suction air to the suction-air introduction port.

2. The cooling mechanism according to claim 1, wherein the base plate is disposed to face the suction-air introduction port of the intake duct.

3. The cooling mechanism according to claim 1, wherein the air rectifier fins are shaped to concentrate the suction-air streams at a center of the base plate.

4. The cooling mechanism according to claim 1, wherein the air rectifier fins are shaped to concentrate the suction-air streams at a corner portion of the base plate.

5. A cooling mechanism comprising:

an intake pipe from which air is sucked for an engine;

an intake duct having a suction-air introduction port opening in the intake pipe;

an air flow meter disposed in the intake duct for detecting an amount of suction air;

an engine electronic control module including a base plate attached to the intake pipe; and an introduction plate, provided in the intake pipe at an upstream side of the base plate, for dividing a suction-air stream into a plurality of streams in the intake pipe and for forcibly introducing at least one of the plurality of streams to the engine electronic control module, wherein the introduction plate includes a discharge port for discharging air of the introduced one stream toward the suction-air introduction port.

6. The cooling mechanism according to claim 5, further comprising air rectifier fins provided on the base plate for cooling the engine electronic control module.

7. The cooling mechanism according to claim 5, further comprising a valve mechanism, provided at a branch portion of the suction-air stream formed by the introduction plate, for adjusting an air amount of the others of the plurality of streams.

8. A cooling mechanism comprising:

an intake pipe from which air is sucked for an engine;

an intake duct having a suction-air introduction port opening in the intake pipe;

an air flow meter disposed in the intake duct for detecting an amount of suction air;

an engine electronic control module including a base plate attached to the intake pipe; and an air-stream changing mechanism, movably provided in the intake pipe at an upstream side of the base plate, for changing a flowing direction of the suction air to thereby concentrate suction-air streams toward the base plate, and transferring the suction air to the suction-air introduction port.

9. The cooling mechanism according to claim 8, further comprising air rectifier fins provided on the base plate for cooling the engine electronic control module.

10. A cooling mechanism according to claim 8, wherein the air-stream changing mechanism changes a degree to which the suction-air streams are concentrated toward the base plate, based on a flow amount of the suction air, by changing the flowing direction of the suction air.

* * * * *